US008235399B2

(12) United States Patent
Tatomir

(10) Patent No.: US 8,235,399 B2
(45) Date of Patent: Aug. 7, 2012

(54) LOCKING MECHANISM FOR AN ICE SKATE BLADE

(76) Inventor: Wally Wayne Tatomir, Raleigh, NC (US)

( * ) Notice: Subject to any disclaimer, the term of this patent is extended or adjusted under 35 U.S.C. 154(b) by 332 days.

(21) Appl. No.: 12/687,556

(22) Filed: Jan. 14, 2010

(65) Prior Publication Data

US 2011/0169232 A1 Jul. 14, 2011

(51) Int. Cl.
*A63C 1/30* (2006.01)

(52) U.S. Cl. ..... 280/11.12; 280/11.18

(58) Field of Classification Search ..... 280/841, 280/11.12, 11.14, 11.15, 11.17, 11.18, 7.13
See application file for complete search history.

(56) References Cited

U.S. PATENT DOCUMENTS 4,218,069 A * 8/1980 Baikie ..... 280/11.12
6,039,328 A * 3/2000 Pawlowski et al. ..... 280/7.13
7,896,363 B2 * 3/2011 Lovejoy ..... 280/7.13

* cited by examiner

*Primary Examiner* — John Walters
(74) *Attorney, Agent, or Firm* — Coats & Bennett, P.L.L.C.

(57) ABSTRACT

An ice skate blade for an ice skate is sized to fit into a holder attached to the sole of the ice skate. The ice skate blade has a pair of tabs that extend into the holder to secure the blade to the holder. A first tab includes a through hole that receives a mechanical fastener that secures the blade to the holder. The second tab includes a lock that contacts the interior of the holder to prevent the skate blade from moving within the holder.

18 Claims, 6 Drawing Sheets

LOCKING MECHANISM FOR AN ICE SKATE BLADE

BACKGROUND

The present invention relates generally to an ice skating blade, and more particularly to an ice skating blade having an integrated gripping element to prevent the movement of the skate blade within a holder.

Ice skating is a favorite activity for many people. Skaters usually glide along an ice surface, periodically make turns, transition between forward and backward skating, and quickly accelerate and decelerate at various times. Typical ice skates have a metal skate blade that inserts into a slot formed along the bottom of the holder. The holder, in turn, fixedly attaches to a bottom surface of a boot. Most holders are manufactured from plastic and have one or more hollow portions formed on the interior of the holder. These hollowed portions or cavities are specifically formed to receive portions of the skate blade, and thus, have a size and shape defined by the manufacturers of the skate blades.

However, the manufacturing and assembly processes for both the skate blade and the holder can vary greatly between models. As a result, although unintentional, the manufacturing processes can introduce small tolerances between the skate blade and the holder that allow the skate blade to move slightly within the holder. This movement or "play" can be bothersome to skaters.

SUMMARY

In one embodiment, an ice skate blade comprises an elongated, metallic member having a longitudinal bottom part that contacts an ice surface, and an opposing longitudinal top part that is sized to fit into a holder. A pair tabs are integrally formed with the blade. The tabs extend from the top part of the blade and into the holder to secure the ice skate blade within the holder. A first tab includes a through hole or opening sized to receive a mechanical fastener that secures the blade to the holder. The second tab includes a gripping element that contacts an interior surface of the holder. The contact substantially prevents the ice skate blade from moving within the holder.

In another embodiment, an ice skate includes a boot that receives a skater's foot, a holder fixedly attached to the sole of the boot, and an ice skate blade locked into the holder. The ice skate blade is sized to at least partially fit into the holder, and is configured to prevent the ice skate blade from moving within the holder. To accomplish this, the blade may comprise first and second tabs that extend from the top part of the blade and into the holder. A first tab includes a through hole or opening sized to receive a mechanical fastener that secures the blade to the holder. The second tab includes a gripping element that contacts an interior surface of the holder. The contact between the gripping element and the interior surface of the holder substantially prevents the ice skate blade from moving within the holder.

DETAILED DESCRIPTION

The present invention provides an ice skate blade, or "runner," that reduces or substantially prevents the "play" or movement of an ice skate blade within a skate blade holder. In one embodiment, the skate blade is an elongated piece of steel that couples longitudinally to a plastic holder disposed on the bottom of a skate boot. A gripping element is integrally formed with the skate blade. When the skate blade is attached to the holder, the gripping element pressingly engages a surface on the inside of the holder. This contact between the gripping element formed on the ice skate blade, and the interior surface of the holder, substantially prevents the skate blade from moving within the holder.

Figure 1:
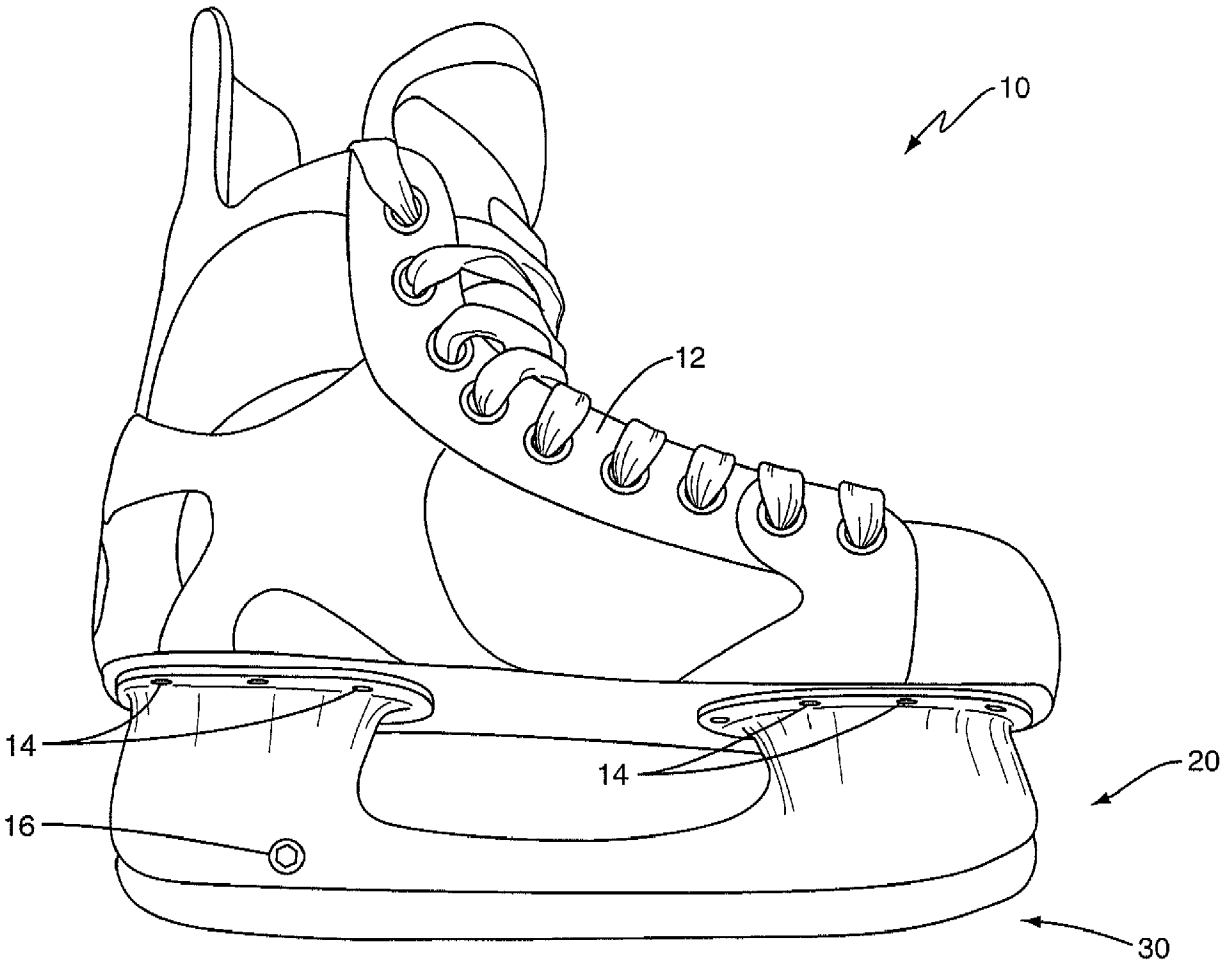
FIG. 1 is a perspective view of an ice skate including a skate blade shaped according to one embodiment of the present invention.

FIG. 1 illustrates a perspective view of an exemplary ice skate 10 suitable for use with a skate blade 30 configured with a gripping element according to one embodiment of the present invention. Skate 10 comprises a boot 12 that encloses a skater's foot, a blade holder 20, and a skate blade 30. As seen in more detail later, the skate blade 30 is formed to include an integral gripping element that prevents the skate blade 30 from moving undesirably within the holder 20. The blade holder 20 connects to the sole of the boot 12 using a plurality of mechanical fasteners such as rivets 14. The skate blade 30 connects to the blade holder 20 using one or more mechanical fasteners such as bolt 16. The mechanical fasteners 14, 16 permit technicians or other knowledgeable personnel to replace the blade holder 20 and/or the skate blade 30 as needed or desired.

Figure 2:
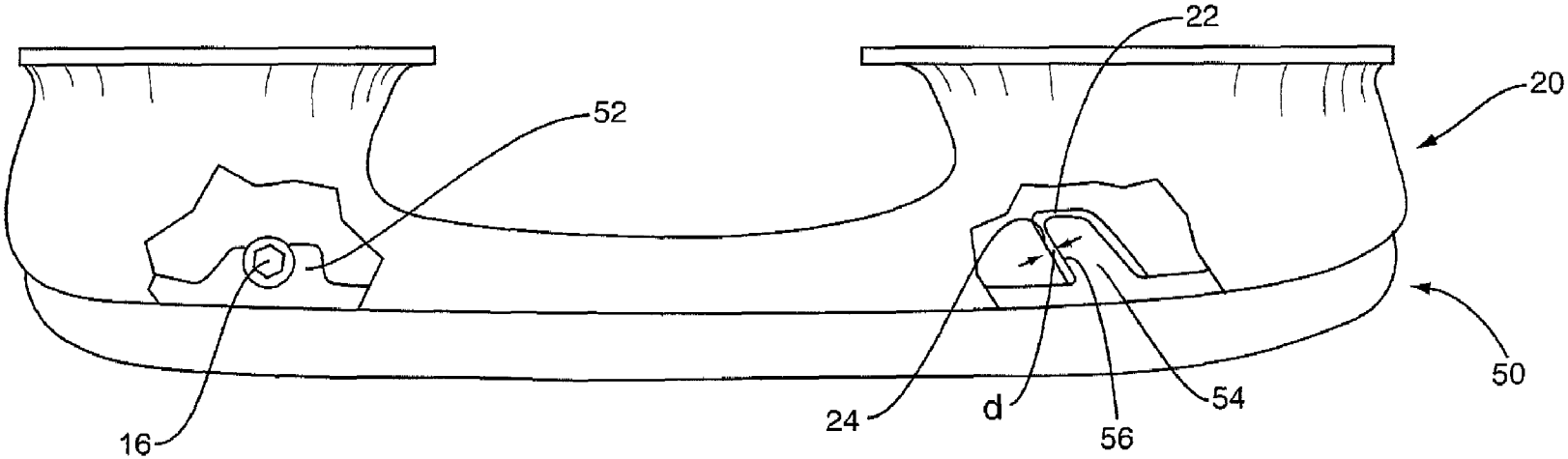
FIG. 2 PRIOR ART
FIG. 2 is a perspective view of a conventional skate blade or runner configured coupled to a skate blade holder.

Conventional skates are fitted with skate blades that move undesirably within the holder 20. FIG. 2, for example, illustrates such a conventional skate blade 50 as comprising an elongated member constructed from a metal such as steel or steel alloy. The conventional blade 50 is formed to include first and second tabs 52, 54 that extend from a top surface of the blade 50 into the interior of the holder 20. The first tab 52 is positioned at the rear or "heel" of the skate 10, and includes an opening or through hole 46. When the skate blade 50 is inserted into the holder 20, the through-hole aligns with a pair of opposing openings or holes formed on each side of the holder 20. A mechanical fastener 16 passes through the aligned openings in the holder 20 and the tab 52, and mates with a corresponding nut (not shown) on the other side of holder 20. When tightened, the mechanical fastener 16 maintains the skate blade 50 securely within the holder 20.

The second tab 54 is integrally formed on the conventional blade 50 at the front or "toe" section of the blade 30, and is sized and shaped to insert into a corresponding cavity 22 formed within holder 20. Generally, the cavity 22 is sized and shaped to conform as closely as possible to the dimensions of second tab 54 provided by the manufacturer of skate blade 50. However, the manufacturing and assembly processes for the skate blade 50 and/or holder 20 are imperfect. Thus, a small distance d is usually present between a surface 56 of the second tab 54 and an interior surface 24 of the cavity 22. This distance d, although small, allows the skate blade 50 to move slightly within the holder 20 with each step or stride a skater takes. Such movement is commonly referred to as "play," and is typically heard as bothersome "clicking" sounds by the skater.

Figure 3:
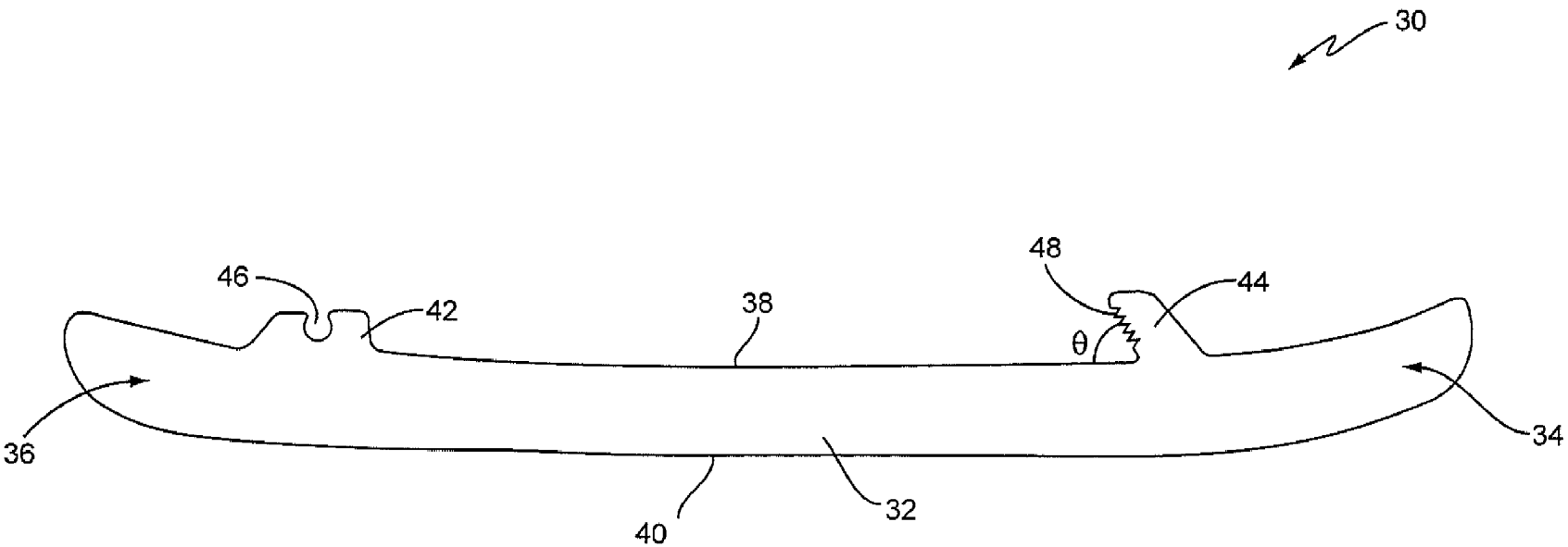
FIG. 3 is a perspective view of a skate blade or runner having a gripping element according to one embodiment of the present invention.
Figure 4:
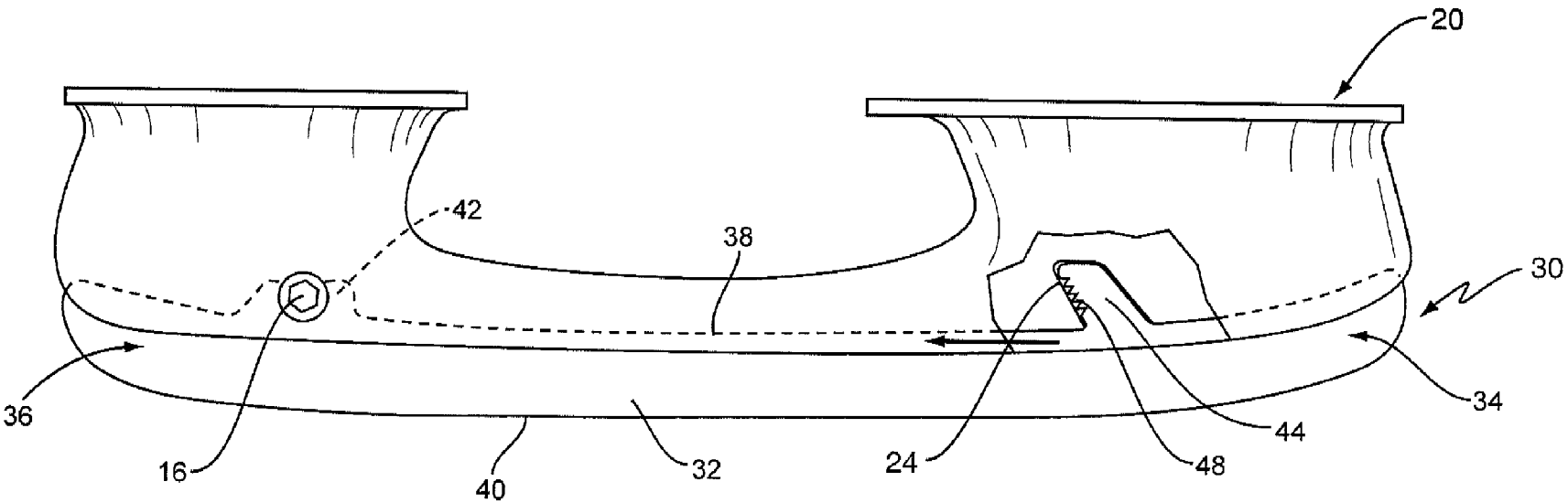
FIG. 4 is a perspective view illustrating how the gripping element of the present invention locks the skate blade into a holder according to one embodiment of the present invention.

FIGS. 3-4 illustrate the skate blade 30 formed according to the present invention to prevent such movement or "play" between the skate blade 30 and the holder 20. Skate blade 30 is constructed as a unitary plate of elongated steel 32 approximately 1/32-3/16 of an inch thick. Skate blade 30 comprises a curved "toe" section 34, a curved "heel" section 36, a top part 38 that fits into a longitudinal recess or slot formed in holder 20, and a bottom part 40. A portion of the bottom part 40 contacts an ice surface when the user is skating. First and second tabs 42, 44 extend from the top part 38 of the skate blade 30, and are disposed proximate the heel and toe portions 36, 34 of the skate blade 30, respectively. A through-hole 46 is formed in the first tab 42 and is sized to receive the mechanical fastener 16 that attaches the skate blade 30 to the blade holder 20. The second tab, which is also formed on the top part 32, extends away from the toe section 34 such that it forms a substantially acute angle θ with the top part 40 of the blade 30.

The skate blade 30 of the present invention deviates from conventional skate blades, such as skate blade 50 shown in FIG. 2, in that the second tab 44 includes a gripping element 48. The second tab 44 inserts into the interior of the holder 20 and prevents movement of the skate blade 30 within the holder 20. In this embodiment, the gripping element 48 comprises a serrated edge integrally formed on the rearward surface of tab 44. The serrated edge may be formed, for example, during the manufacturing process on a side of tab 44 facing the heel of skate blade 30. When mated to the holder 20, as seen in FIG. 4, the serrated edge 48 contacts the interior surface 24 of cavity 22. The mechanical fastener 16, when tightened by a user, exerts a tensioning force that "pulls" the blade 30 rearward towards the heel of the holder 20 (i.e., in the direction of the arrow). This forces the serrated edge to pressing engagement with the contact surface 22 such that the serrated edge "grips" the contact surface 22 on the interior of holder 20. In this position, the skate blade 30 is substantially prevented from moving within the holder 20, thereby eliminating the "clicking" sounds heard by a skater.

Figure 5:
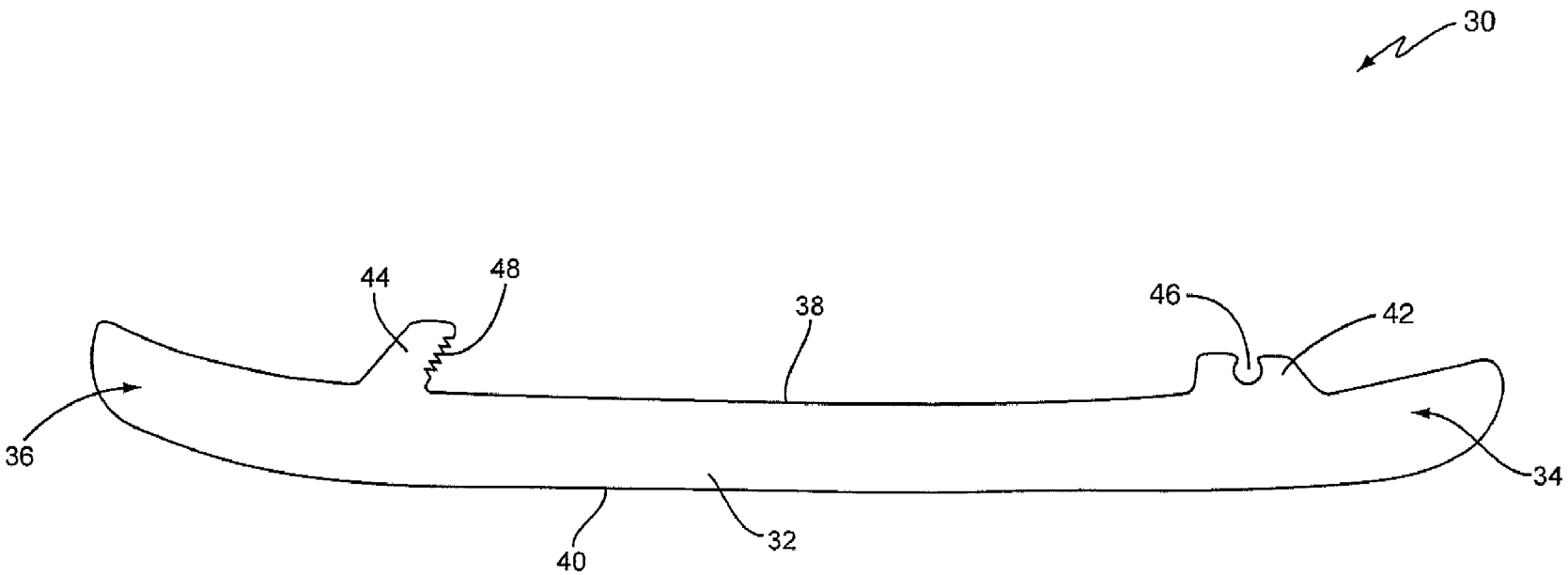
FIG. 5 is a perspective view illustrating a skate blade having a gripping element according to other embodiments of the present invention.

FIG. 5 illustrates another embodiment wherein the first tab 44 includes serrated edge as a gripping element 48, and the second tab 42 includes the through-hole 46. In this embodiment, the serrated edge is formed on a forward-facing surface of the first tab that leans towards the toe section 32 of skate blade 30, and is forced into contact with an interior surface of a corresponding cavity formed within the interior of holder 20, as previously described. Regardless of its placement and orientation (i.e., forward or rearward facing), the gripping element 48 seen in FIG. 5 also prevents movement of the skate blade 30 within the holder 20 as previously described.

Figure 6:
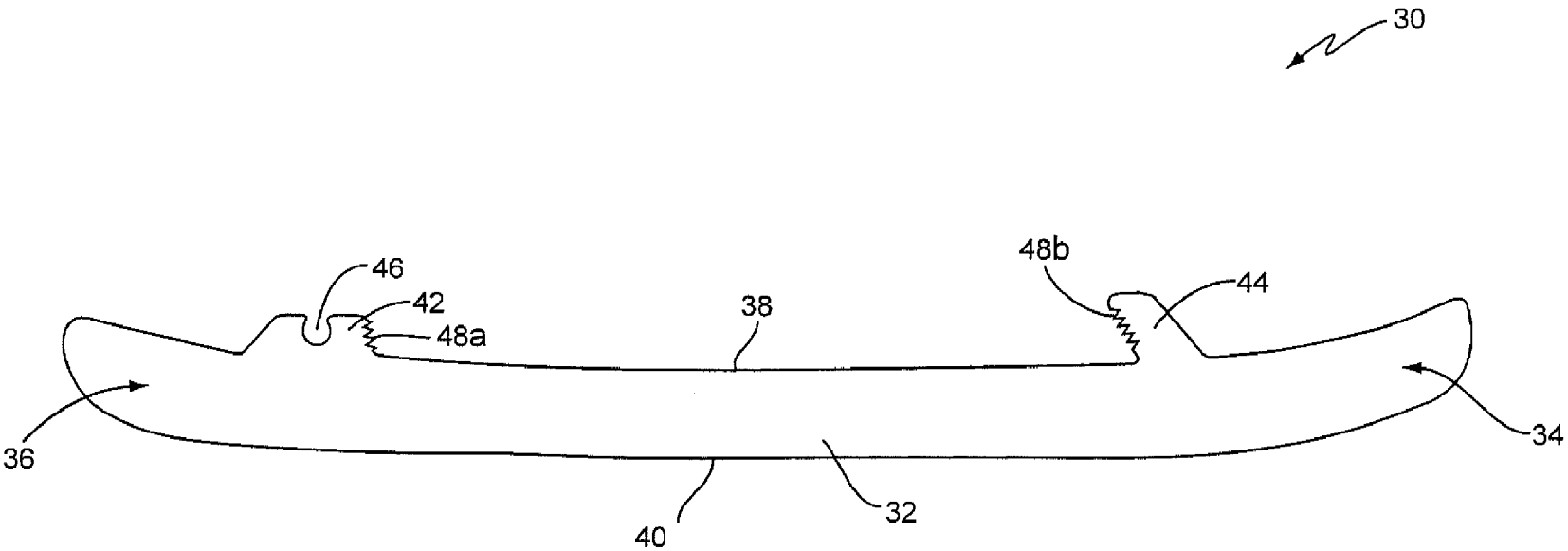
FIG. 6 is a perspective view illustrating a skate blade having multiple gripping elements according to one embodiment of the present invention.

FIG. 6 illustrates another embodiment wherein the skate blade 30 comprises multiple gripping elements 48*a*, 48*b*. Both gripping elements 48*a*, 48*b* are formed as serrated edges on respective rearward facing surfaces of tabs 42, 44. When mated to the holder 20, the serrated edges contact their respective interior surfaces of their corresponding cavities within holder 20. A mechanical fastener 16 extends through the holder 20 and the hole 46 and is tightened by the user. The serrated edges are thus placed into pressing engagement with their respective contact surfaces such that the serrated edges "grip" their corresponding contact surfaces on the interior of holder 20. In this position, the skate blade 30 is substantially prevented from moving within the holder 20, thereby eliminating the "clicking" sounds heard by a skater.

The present invention may, of course, be carried out in other ways than those specifically set forth herein without departing from essential characteristics of the invention. For example, in some embodiments, the gripping element 48 is formed on one or both of the tabs such that they extend from the top part of the blade 30 to form an acute angle θ with the top part of the blade 30. However, this is merely illustrative. The gripping element 48 may be formed on one or both of the tabs 42, 44 such that they extend at a 90° or greater angle with respect to the top part of the blade 30.

Further, the figures illustrate the gripping elements 48 as being disposed on the front-facing surface of the tabs 42 or 44, or the rearward-facing surface of tabs 42 and/or 44. However, those skilled in the art will readily appreciate that the present invention is not so limited. In one embodiment, one of the gripping elements 48*a*, 48*b* is formed on the front-facing surface of one of the tabs 42, 44, while the other gripping elements 48*a*, 48*b* is formed on the rearward facing surface of the other tab 42, 44.

Therefore, the present embodiments are to be considered in all respects as illustrative and not restrictive, and all changes coming within the meaning and equivalency range of the appended claims are intended to be embraced therein.

What is claimed is:

1. An ice skate blade comprising:

an elongated blade having a bottom part to contact a ice surface, and an opposing top part to fit into a blade holder;

first and second tabs extending from the top part of the blade, the first tab configured to receive a mechanical fastener that connects the blade to the blade holder; and a gripping element comprising a serrated edge integrally formed on the second tab and configured to grip an opposing interior surface wall of the blade holder to substantially reduce movement of the blade within the holder.

2. The ice skate blade of claim 1 wherein the first and second tabs are sized to be inserted into an interior of the holder.

3. The ice skate blade of claim 1 wherein the second tab extends from the top part of the blade such that the second tab forms an acute angle θ with the top part.

4. The ice skate blade of claim 1 wherein the first tab is formed on a toe section of the blade, and the second tab is formed on a heel section of the blade.

5. The ice skate blade of claim 1 wherein the first tab is formed proximate a heel section of the blade, and the second tab is formed proximate a toe section of the blade.

6. The ice skate blade of claim 1 wherein the gripping element is formed on a rearward facing surface of the second tab.

7. The ice skate blade of claim 1 wherein the gripping element is formed on a forward facing surface of the second tab.

8. The ice skate blade of claim 1 wherein the gripping element comprises a first serrated edge, and further comprising a second gripping element comprising a serrated edge integrally formed on a surface of the first tab, and configured to grip another opposing interior surface wall of the blade holder to reduce movement of the blade.

9. An ice skate comprising:

a boot to receive a skater's foot;

a blade holder fixed to a sole of the boot; and a skate blade comprising:

an elongated blade having a bottom part to contact a ice surface, and an opposing top part to fit into a blade holder;

first and second tabs extending from the top part of the blade, the first tab configured to receive a mechanical fastener that connects the blade to the blade holder; and a gripping element comprising a serrated edge integrally formed on the second tab and configured to grip an opposing interior surface wall of the blade holder to substantially reduce movement of the blade moving within the holder.

10. The ice skate of claim 9 wherein the first and second tabs are sized to be inserted into an interior of the holder.

11. The ice skate of claim 9 wherein the second tab extends from the top part of the blade such that the second tab forms an acute angle θ with the top part.

12. The ice skate of claim 9 wherein the first tab is formed proximate a toe section of the blade, and the second tab is formed proximate a heel section of the blade.

13. The ice skate of claim 9 wherein the first tab is formed proximate a heel section of the blade, and the second tab is formed proximate a toe section of the blade.

14. The ice skate of claim 9 wherein the gripping element is formed on a rearward facing surface of the second tab.

15. The ice skate of claim 9 wherein the gripping element is formed on a forward facing surface of the second tab.

16. The ice skate of claim 9 wherein the gripping element comprises a first serrated edge, and further comprising a second gripping element comprising a serrated edge integrally formed on a surface of the first tab, and configured to grip another opposing interior surface wall of the blade holder to reduce movement of the blade.

17. An ice skate blade comprising:

an elongated blade having a bottom part to contact a ice surface, and an opposing top part to fit into a blade holder;

first and second tabs extending from the top part of the blade, the first tab configured to receive a mechanical fastener that connects the blade to the blade holder; and a serrated edge configured to substantially prevent movement of the blade within the blade holder, the serrated edge being integrally formed on the second tab and configured to pressingly engage and grip an opposing contact surface within the blade holder responsive to a tensioning force exerted on the blade.

18. The ice skate blade of claim 17 wherein the serrated edge comprises teeth configured to contact and grip the opposing contact surface within the blade holder.

* * * * *